US006160862A

United States Patent [19]

Wiencek et al.

[11] Patent Number: 6,160,862

[45] **Date of Patent: *Dec. 12, 2000**

[54] METHOD FOR FABRICATING $^{99}$MO PRODUCTION TARGETS USING LOW ENRICHED URANIUM, $^{99}$MO PRODUCTION TARGETS COMPRISING LOW ENRICHED URANIUM

[75] Inventors: Thomas C. Wiencek, Orland Park; James E. Matos, Oak Park; Gerard L. Hofman, Downers Grove, all of Ill.

[73] Assignee: The United States of America as represented by the United States Department of Energy, Washington, D.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/911,265

[22] Filed: Aug. 14, 1997

Related U.S. Application Data

[63] Continuation-in-part of application No. 08/130,485, Oct. 1, 1993, abandoned.

[51] Int. Cl.[7] ..... G21G 1/02

[52] U.S. Cl. ..... 376/202; 376/170; 376/186; 376/414; 376/455; 29/17.6; 29/525; 285/332

[58] Field of Search ..... 376/202, 186, 376/414–416, 418, 432, 455, 170; 29/525, 17.3, 17.6; 285/332

[56] References Cited

U.S. PATENT DOCUMENTS

| | | | |
|---|---|---|---|
| 2,034,425 | 3/1936 | Allsworth | 29/19 |
| 2,375,334 | 5/1945 | Valyi et al. | 29/155 |
| 2,645,842 | 7/1953 | Orr | 29/19 |
| 2,941,933 | 6/1960 | Roake et al. | 376/455 |

(List continued on next page.)

FOREIGN PATENT DOCUMENTS

| | | | |
|---|---|---|---|
| 1068832 | 12/1979 | Canada | 376/186 |
| 2134263 | 10/1995 | Canada . | |
| 2134264 | 10/1995 | Canada . | |
| 1197317 | 11/1959 | France | 376/455 |

(List continued on next page.)

OTHER PUBLICATIONS

Irradiation Test of $^{99}$Mo Production Employing Uranium Metal Foils by G.L. Hofman et al., presented at the 1996 International Meeting on Reduced Enrichment for Research and Test Reactors, Oct. 7–10, 1996 Seoul, South Korea.

Leu $^{99}$Mo Fabrication and Testing: Overview, Status and Plans by T.C. Wiencek et al., presented at the 17th International Meeting on Reduced Enrichment for Research and Test Reactors, Sep. 18–22, 1994 Williamsburg, VA.

Development of Uranium Metal Targets for $^{99}$Mo Production by T.C. Wiencek et al., presented at the 16th International Meeting on Reduced Enrichment for Research and Test Reactors, Oct. 3–7, 1993 Oarai, Ibaraki, Japan.

*Primary Examiner*—Harvey E. Behrend

*Attorney, Agent, or Firm*—Mark F. LaMarre; Mark P. Dvorscak; William R. Moser

[57] ABSTRACT

A radioisotope production target and a method for fabricating a radioisotope production target is provided, wherein the target comprises an inner cylinder, a foil of fissionable material circumferentially contacting the outer surface of the inner cylinder, and an outer hollow cylinder adapted to receive the substantially foil-covered inner cylinder and compress tightly against the foil to provide good mechanical contact therewith. The method for fabricating a primary target for the production of fission products comprises preparing a first substrate to receive a foil of fissionable material so as to allow for later removal of the foil from the first substrate, preparing a second substrate to receive the foil so as to allow for later removal of the foil from the second substrate; attaching the first substrate to the second substrate such that the foil is sandwiched between the first substrate and second substrate to prevent foil exposure to ambient atmosphere, and compressing the exposed surfaces of the first and second substrate to assure snug mechanical contact between the foil, the first substrate and the second substrate.

20 Claims, 2 Drawing Sheets

U.S. PATENT DOCUMENTS

| | | | |
|---|---|---|---|
| 2,967,139 | 1/1961 | Bartoszak | 376/455 |
| 2,986,504 | 5/1961 | Goslee et al. | 376/432 |
| 3,004,907 | 10/1961 | Precht et al. | 376/455 |
| 3,070,880 | 1/1963 | Davis et al. | 376/432 |
| 3,109,797 | 11/1963 | Maxwell | 376/455 |
| 3,129,140 | 4/1964 | Stohr et al. | 376/455 |
| 3,202,583 | 8/1965 | Salesse et al. | 376/455 |
| 3,290,224 | 12/1966 | Robertson | 376/455 |
| 3,291,699 | 12/1966 | Trickett et al. | 376/455 |
| 3,384,551 | 5/1968 | Kornbichler | 376/455 |
| 3,422,523 | 1/1969 | Kling | 376/455 |
| 3,434,192 | 3/1969 | Ormerod | 29/411 |
| 3,436,307 | 4/1969 | Johnson et al. | 376/432 |
| 3,619,366 | 11/1971 | Chubb et al. | 376/455 |
| 3,634,190 | 1/1972 | Kilp et al. | 376/455 |
| 3,728,220 | 4/1973 | Prince et al. | 376/455 |
| 3,928,132 | 12/1975 | Bujas | 376/455 |
| 3,940,318 | 2/1976 | Arino et al. . | |
| 3,955,093 | 5/1976 | Quinby | 376/202 |
| 4,554,721 | 11/1985 | Carty et al. | 29/416 |
| 4,720,370 | 1/1988 | Travelli | 376/432 |
| 4,751,044 | 6/1988 | Hwang et al. | 376/416 |
| 4,839,133 | 6/1989 | Vandegrift et al. | 376/202 |
| 4,876,780 | 10/1989 | Stahl et al. | 29/157.4 |
| 4,960,562 | 10/1990 | Okuda et al. | 376/416 |
| 4,963,317 | 10/1990 | Wiencek et al. | 376/422 |
| 5,056,209 | 10/1991 | Ohashi et al. | 29/517 |
| 5,079,824 | 1/1992 | Lopez et al. | 29/402.13 |

FOREIGN PATENT DOCUMENTS

| | | | |
|---|---|---|---|
| 1530633 | 6/1968 | France . | |
| 2132867 | 1/1972 | Germany | 376/455 |
| 0272161 | 9/1989 | Germany | 376/202 |
| 768078 | 2/1957 | United Kingdom . | |
| 933817 | 8/1963 | United Kingdom . | |
| 1096303 | 12/1967 | United Kingdom . | |
| 1198565 | 7/1970 | United Kingdom . | |

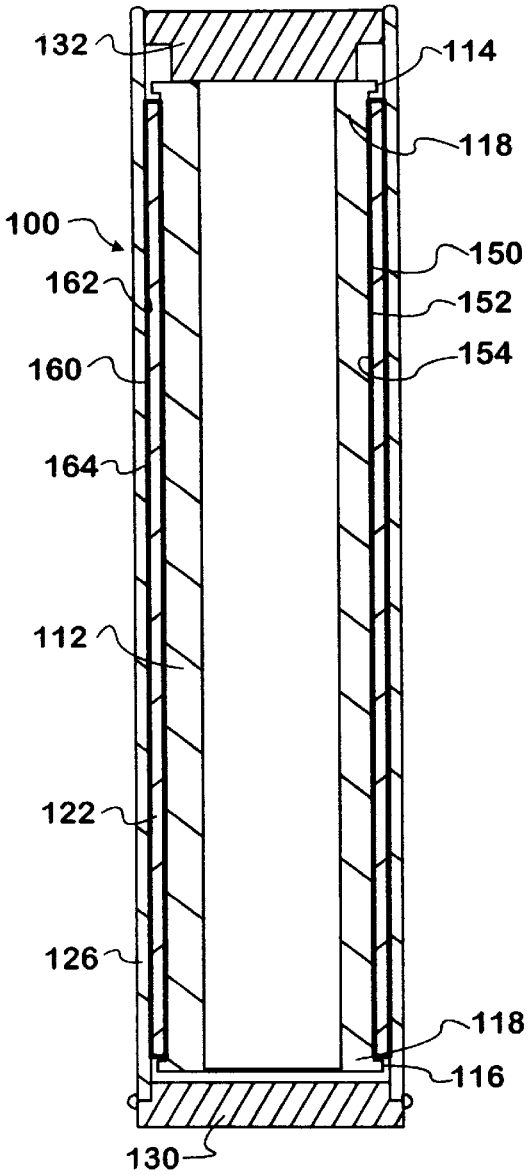
FIG. 3
FIG. 3a
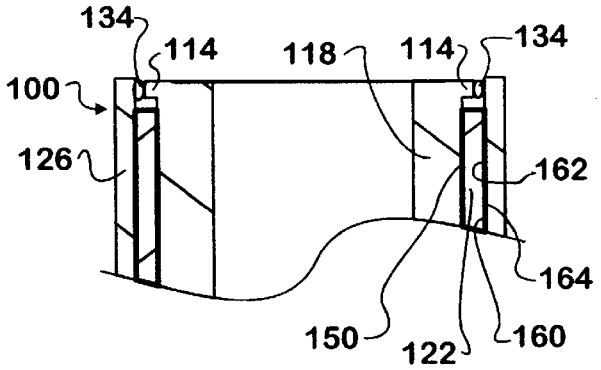
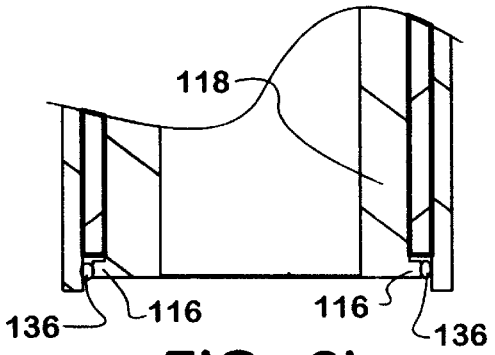
FIG. 3b

METHOD FOR FABRICATING $^{99}$MO PRODUCTION TARGETS USING LOW ENRICHED URANIUM, $^{99}$MO PRODUCTION TARGETS COMPRISING LOW ENRICHED URANIUM

This application is a continuation-in-part, of application Ser. No. 08/130,485, filed Oct. 1, 1993 now abandoned.

CONTRACTUAL ORIGIN OF THE INVENTION

The United States Government has rights in this invention pursuant to Contract Number W-31-109-ENG-38 between the United States Government and Argonne National Laboratory.

BACKGROUND OF THE INVENTION

1. Field of the Invention

The present invention relates to a radioactive isotope production target and a method for fabricating a radioactive isotope production target and more specifically to a 99Mo production target and a method for fabricating a 99Mo production target using low enriched uranium.

2. Background of the Invention

The use of radioactive isotopes is widespread, and includes applications in such diverse fields as industrial flow rate processes environmental investigations and medicine. These radioisotopes are produced primarily by bombarding highly enriched uranium (HEU), or $^{235}$U with neutrons to produce the daughters. While the demand for radioisotopes continues to increase, the use of HEU continues to be discouraged, primarily as HEU can be reprocessed for nuclear weaponry development. Since the United States desires to curtail the export of HEU, it is necessary to find a substitute target material.

One of the major isotopes used in medicine is Technetium-99 m, primarily as this isotope has a short-lived half-life of approximately six hours. Technetium-99 m for medical purposes is a decay product of $^{99}$Mo, which is produced in research reactors from the fissioning of $^{235}$U or from neutron capture in $^{98}$Mo to make the heavier $^{99}$Mo. $^{99}$Mo has a half-life of 66 hours.

$^{99}$Mo is produced using a variety of target designs that contain highly enriched uranium (HEU) of approximately 93 percent $^{235}$U. These designs include cladding shaped as plates, rods and cylinders with uranium material inserted therein. Fuel plate designs utilize a sandwich configuration wherein the fissionable material in the form of a wire or a "meat" matrix resides between two plates of nonfissionable material, such as zirconium, aluminum, nickel, or alloys thereof. The advantage of these designs is efficient heat transfer throughout the target. A disadvantage of these plate designs is the need to dissolve the matrix with high volumes of solution to obtain the fission products. Such processes result in product being lost and/or further decaying prior to use. In addition, many plate designs require the use of highly enriched uranium.

Fuel rod designs (U.S. Pat. Nos. 3,799,883 and 3,940,318) eliminate those losses experienced when processing the products of HEU fission from plate configurations. Such HEU target rods comprise a hollow cylindrical can with a thin layer of $UO_2$ coated to the inside wall. Molybdenum recovery is accomplished by adding an acid solution into the target cylinder to dissolve the irradiated $UO_2$ from the cylinder wall for later processing. However, these rod configurations are limited in that they can accommodate only relatively thin layers of $UO_2$ coating, of approximately 0.001 inches. Such thicknesses can result in reasonable yields of $^{99}$Mo if HEU is employed as the fissionable material, but not if low enriched uranium (LEU) is used. Approximately five to six times the uranium must be processed and recovered for the same $^{99}$Mo yield obtained in HEU processes. However, increasing the thickness of LEU coatings in rod configurations does not work, as flaking of the material off the inside of the cylinder occurs at effective thicknesses beginning at approximately 0.002 inches.

A need exists in the art for a $^{99}$Mo target wherein said target exhibits good heat transfer, has low chemical processing requirements, and incorporates simple design configurations. Such a target must use only low enriched uranium as fissionable material.

SUMMARY OF THE INVENTION

It is an object of the present invention to provide a radioisotope production target and a method for producing the same which overcomes many of the disadvantages of the prior art.

It is another object of the present invention to economically provide a relatively simple radioisotope production target. A feature of the invented product is the use of easily removable, low enriched fissionable material. An advantage of the invented product and process is the elimination of complicated fabrication processes and chemical processing steps, thereby affording developing nations the opportunity to produce radioisotopes.

Yet another object of the present invention is to provide a radioisotope production target without using high enriched uranium. A feature of the invention is using low enriched uranium as a fissionable material. An advantage of the invention is minimizing export and usage of high enriched uranium thereby maximizing both material handling safety and security against pro-nuclear weapon nations.

Still another object of the present invention is to provide a method for fabricating a radioisotope production target using fabrication techniques that do not require bonding the fissionable material with target cladding. A feature of the invention is using mechanical compression forces only to conjoin elements of the invention. An advantage of the invention is the elimination of processes heretofore necessary to separate fissionable materials from nonfissionable materials after irradiation.

Briefly, the invention provides for a radioisotope production target comprising an inner cylinder having an outer surface, a first end, and a second end, an inner barrier, having a first surface and a second surface, in contact with the inner cylinder outer surface a foil of fissionable material circumferentially contacting the first surface of the inner barrier, where the foil and the inner barrier to substantially cover the outer surface of the inner cylinder, an outer barrier, having a first surface and a second surface, in contact with the foil of fissionable material and an outer hollow cylinder having an inner surface, a first end, and a second end, said inner surface of the outer hollow cylinder adapted to receive the substantially foil covered inner cylinder and compress tightly against the foil against the outer barrier to provide good mechanical contact therewith.

The invention also provides for a method for fabricating a primary target for the production of fission products comprising choosing a first substrate having a first substrate first surface, a first substrate second surface, a first substrate peripheral edge, and a first substrate predetermined thickness, preparing the first substrate first surface to receive a foil of fissionable material, said foil of fissionable material having a first foil surface, a second foil surface, and a predetermined thickness and inner and outer barriers, both barriers having a first and second surfaces, contacting the foil first surface with the first substrate first surface so that the inner barrier second surface is in contact with the first substrate first surface so as to allow for later removal of the foil from the first substrate, choosing a second substrate having a second substrate first surface, a second substrate second surface, a second substrate peripheral edge, and a second substrate predetermined thickness, preparing the second substrate first surface to receive the foil second surface so that the outer barrier second surface is in contact with the second substrate first surface so as to allow for later removal of the foil from the second substrate; attaching the first substrate peripheral edge to the second substrate peripheral edge such that the first substrate second surface and the second substrate second surface are exposed to ambient atmosphere and the foil and the inner and outer barriers are sandwiched between the first substrate and second substrate to prevent foil exposure to ambient atmosphere, and compressing the exposed first substrate second surface and the second substrate second surface to assure snug mechanical contact between the foil, the inner barrier and the first substrate first surface and between the foil, the outer barrier and the second substrate first surface.

BRIEF DESCRIPTION OF THE DRAWING

The present invention together with the above and other objects and advantages may best be understood from the following detailed description of the embodiment of the invention illustrated in the drawings, wherein:

FIG. 3 is a longitudinal cross sectional view of a second embodiment of the invented target.

FIG. 3*a* is a detail of FIG. 3 first end showing an alternate means of securing the inner tube within the outer tube.

FIG. 3*b* is a detail of FIG. 3 second end showing an alternate means of securing the inner tube within the outer tube.

DETAILED DESCRIPTION OF THE INVENTION

Figure 1:
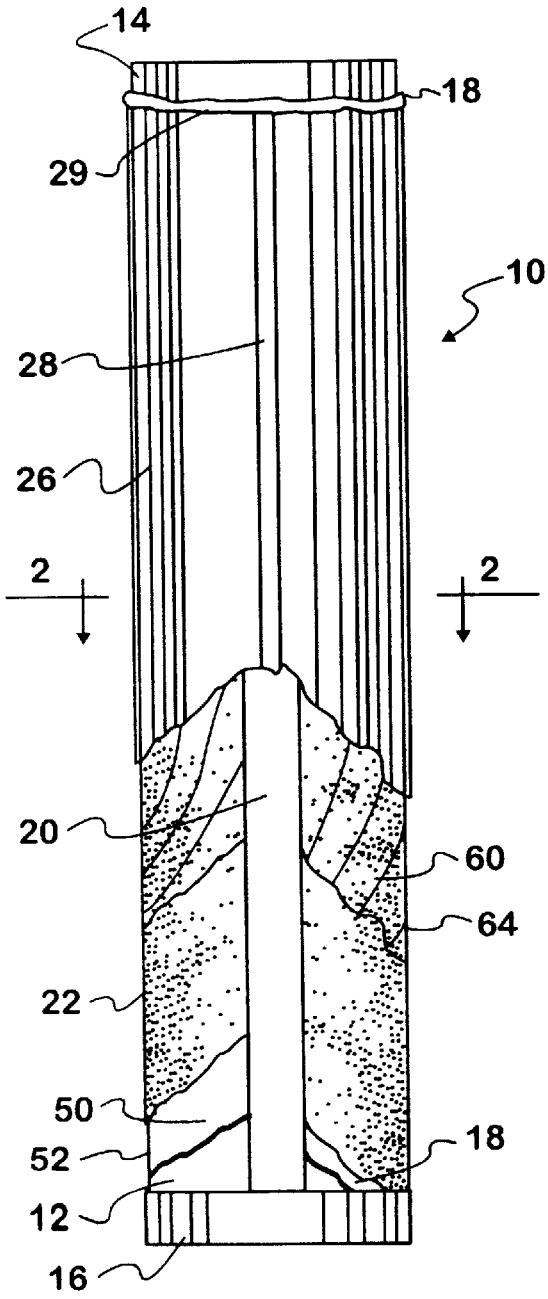
FIG. 1 is a partial cut-way view of a first embodiment of the invented target.

The present invention comprises three different designs. The first design, designated generally as 10 and partially depicted in an elevated view as FIG. 1, consists of an inner tube 12, a sheet or foil 22 of fissionable material wrapped around said inner tube 12, and an outer tube 26 in turn encircling the foil-wrapped hollow inner tube 12.

The inner tube 12 has a raised first end 14 and raised second end 16, each end raised to the same predetermined height relative to the surface of the inner tube 12, thereby effecting a relatively depressed center section 18. A narrow welding rib 20 integrally attached longitudinally to the inner tube 12 is further integrally attached to the first raised end 14 and second raised end 16. The depressed center section 18 is adapted to receive a sheet or foil of low enriched fissionable material 22 having a thickness ranging between 1 mils (0.001 inches) and 10 mils (0.01 inches), said thickness not to exceed the difference in the height of the raised ends 14, 16.

The sheet or foil 22 is generally rectangular and constructed so that two opposite sides of the foil 22, have a length equal to that of the depressed center section 18 of the inner tube 12. The sheet or foil 22 is further configured so that when it is wrapped circumferentially around the depressed center section 18, its remaining two opposite sides will abut against the raised rib 20. The foil 22 remains substantially in place once set into the depressed center section 18.

Additionally, the subject invention includes at least one, but preferably two, metallic fission-recoil barriers. One barrier, an inner barrier generally designated 50, includes a first surface 52 and a second surface 54 that forms a layer on the foil of fissionable material 22, so that the first surface 52 of the inner barrier 50 is in contact with the inner surface of the foil of fissionable material 22, and the second surface 54 is in contact with the outer surface of the inner hollow tube 12. The other barrier, an outer barrier generally designated 60, includes a first surface 62 and a second surface 64 that forms a layer on the foil of fissionable material 22, so that the first surface 62 of the outer barrier 60 is in contact with the outer surface of the foil of fissionable material 22, and the second surface 64 is in contact with the inner surface of the outer hollow tube 12.

Figure 2:
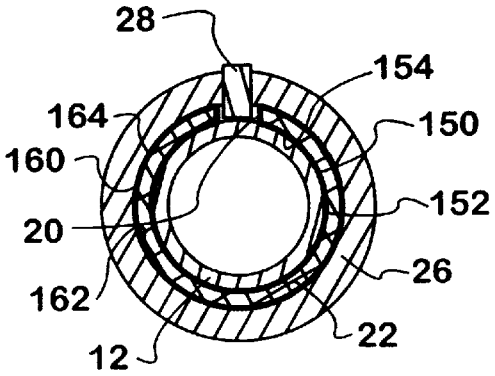
FIG. 2 is a cross sectional view of FIG. 1 taken along the line 2—2.

As depicted in FIG. 2., which is a cross sectional view of FIG. 1 taken along line 2—2, the first embodiment 10 further consists of an outer hollow tube 26 or sleeve, having a slit opening extending longitudinally the entire length of the tube 26. The outer hollow tube 26 is fitted tightly over the inner hollow tube 12, foil 22 and the inner and outer barriers 50 and 60 such that the split is positioned over the welding rib 20. The outer hollow tube 26 is then compressed against the foil 22 and the outer barrier 60 to assure good mechanical contact and the edges of the slit of the tube 26 are then abutted together by a weld 28 or other suitable means. Compression can be done mechanically with hose-clamp devices. The ends of the outer hollow tube 26 are subsequently sealed by welds 29, or other suitable means, to the raised first end 14 and second end 16 so as to prevent foil exposure to ambient atmosphere when the target is cycled. Typically, welding is performed in an inert atmosphere, such as in a glove box permeated with nitrogen or argon.

Compression of the assembled target also can be effected hydraulically whereby the inner tube is plastically deformed just prior to welding the ends of the outer hollow tube 26 to the raised first end 14 and raised second end 16 of the inner hollow tube 12 to seal the tube. Any method of compression can be employed, so long as close mechanical contact between the inner hollow tube 12 and outer hollow tube 26 and the foil 22, as depicted in FIG. 2, is achieved to ensure good thermal conduction.

In a second embodiment of the invention, depicted as 100 in FIG. 3, a two-tube configuration is also used wherein an outer tube 126 slidably receives an inner tube 112.

As with the inner hollow tube 12 of the first embodiment 10, the inner tube 112 of this second embodiment 100 has a raised first end 114 and raised second end 116 so as to provide a depressed center section 118 to receive a sheet or foil of fissionable material 122. Said fissionable material is wrapped circumferentially around the inner tube 112, with the now wrapped inner tube 112 then being inserted into the outer tube 126. Unlike the first embodiment 10, the outer tube 126 of the second embodiment 100 is not longitudinally split from end to end. Therefore, to assure good mechanical contact between the outside surface of the inner tube 112, the sheet or foil of fissionable material 122, and the inside surface of the outer tube 126, the two tubes are tapered to assure a snug fit. In the preferred embodiment, the inner tube 112 is tapered 0.005 inches for every 1 inch, moving from the raised first end 114 to the raised second end 116.

Pressure is applied to further assure a tight fit in methods similar to those outlined above for the first embodiment 10. In one such process, the outer tube 126, is first closed at one end with a plug of similar metal 130. During compression, the top closure plug 132 is pressed down on the inner tube 112 and welded to the outer tube 126 under load to ensure maximum tightness in the assembly. The end plugs 130 and 132, are received in a male-female fashion by the ends of the outer tube 126.

Additionally, the subject invention includes at least one, but preferably two, metallic fission-recoil barriers. One barrier, an inner barrier generally designated 150, includes a first surface 152 and a second surface 154 that forms a layer on the foil of fissionable material 122, so that the first surface 152 of the inner barrier 150 is in contact with an inner surface of the foil of fissionable material 122, and the second surface 154 is in contact with an outer surface of the inner tube 112. The other barrier, an outer barrier generally designated 160, includes a first surface 162 and a second surface 164 that forms a layer on the foil of fissionable material 122, so that the first surface 162 of the outer barrier 160 is in contact with the outer surface of the foil of fissionable material 122, and the second surface 164 is in contact with the inner surface of the outer tube 126.

The mechanical bond between the foil 122 and the tubes is further enhanced when the temperature of the device increases during radiation, particularly when the material comprising the inner tube 112 is selected to have a higher coefficient of thermal expansion than the outer tube 126. For example, as aluminum has approximately a 2.5 fold higher coefficient of thermal expansion than zircaloy, any heating of an embodiment having an aluminum inner tube and a zircaloy outer tube will result in a tighter mechanical bond of the two tubes and the foil sandwiched between the tubes.

The target is disassembed by cutting off the top plug 132 and pulling out the inner tube 112 with the foil 122. The taper will assist in this operation.

In a third embodiment of the present invention the inside surface of an outer tube is lined with a sheet or foil of fissionable material and an outer barrier. A first surface of the foil is held securely against an outer recoil barrier which in turn is held securely against the inside surface of the outer tube with a metal cylinder (solid, tubular or sectioned) that contacts and is mechanically expanded against an inner barrier that is in contact with a second surface of the foil. As with the previous two embodiments, the tight contact ensures that fission heat from the foil can be transferred through the tube wall to a coolant material.

Substrate Detail

A myriad of materials can be utilized as the substrate material al for the above-described embodiments. For example, nonfissionable metal materials selected from the group consisting of steel, stainless steel, nickel, nickel alloy, zirconium, zircaloy, aluminum, or zinc coated aluminum can be employed. A variety of zircaloys are suitable, including, but not limited to reactor grade zirconium (UNS# R60001), Zirconium-tin alloy (UNS# R60802), Zirconium-tin alloy (UNS# R60804), and Zirconium-niobium alloy (UNS# R60901). A myriad of substrate shapes are also suitable, including cylinders, plates, spheres and ovals. When dealing with arcuate-shaped substrates, mechanical bonding between substrates and foil is enhanced when a first substrate having the usable convex surface has a higher coefficient of thermal expansion relative to the mating substrate having the concave surface. Upon cycling (and therefore, heating), the convex surface will expand against a first surface of the foil to enhance mechanical bonding. For example, the inventors have determined that with the thermal expansion coefficient of zircaloy of $6–10\times10^{-6}$, and the thermal expansion coefficient of aluminum at $25\times10^{-6}$, approximately 3 millimeters of interference occurs at 100° C. if the first substrate consists of aluminum and the second substrate consists of zircaloy.

The general dimensions of the target are limited only by reactor design. When working with cylinder-shaped targets, production runs typically require 18 inch lengths. Outer diameters of said cylindrical targets can vary from 2.5 cm to 5.8 cm (1 inch to 2 inches). For example, the outer diameter of the cylinders used by the inventors was approximately 3.8 cm for aluminum and 3.2 cm for stainless steel. Cylinder wall thicknesses can vary, but generally range from approximately 0.025 to 0.060 inches. Generally, wall thicknesses are not critical, provided that proper heat conductance is achieved.

Preparation of the receiving surfaces of the substrates are crucial, as an advantage of the invention is easy removal of the irradiated foil from the target after cycling. Sticking of the foil, even after compression and cycling, is to be avoided. To avoid such diffusion bonding between the foil and the substrate surfaces, the receiving substrate surfaces are either anodized (to provide an oxide over the metal), or nitrided (whereby the substrate is first subjected to pack-nitriding and then fired).

The invented fabrication process and targets provide for target operation between the ranges of approximately 100° C. and 500° C.

Foil Detail

The method for fabricating the targets, and the targets themselves, utilize low enriched uranium metal or plutonium metal. An advantage of the invention is that a relatively low percent of the total weight of these metals is radioactive isotope. For example, low enriched uranium foil has approximately 19.8 percent $^{235}U$.

Foil thicknesses can vary, depending on the target configuration. Thicknesses can range from between approximately 0.001 inches to 0.01 inches. It is the design and fabrication of the invented targets that accommodates the heretofore restrictively high foil thicknesses of more than 0.002 inches, therefore providing an advantage over current state of the art.

A supplier for these foils is Marketing Services Corporation, Oak Ridge, Tenn.

Barrier Detail

As provided previously, one of the objectives of the present invention is to reduce or eliminate bonding between the fissionable material and the target cladding. Radiation (recoil) enhanced diffusion can cause the foil to bond with the inner and outer tubes making disassembly difficult. Recoil atom absorbing barriers are necessary to prevent such recoil enhanced diffusion, and thus bonding. A number of metals have been found effective for use as recoil barriers, including, but not limited to, copper, nickel, iron and zinc. A primary target using one barrier between the outer surface of the foil and the inner surface of the outer tube, or preferably two barriers between the foil of fissionable material and the inner and outer tubes is described above. When one barrier is used, it is preferred that the barrier be comprised of nickel metal, however, when two barriers are utilized, either nickel or copper is preferred. Furthermore, while it is contemplated that the barriers may be of different metals, in the preferred embodiment both barriers are selected from the same metal.

Barrier thickness can vary, depending upon the target configuration and the application. Such thickness can range from between approximately 10 micrometers to 100 micrometers. However, since the recoil range for copper and nickel is approximately 7 micrometers (0.000275 inches), a barrier having a predetermined thickness of approximately 10 micrometers (0.00039 inches) is preferred. Additionally the manner in which the barrier is applied can vary. It is contemplated that the metal recoil barriers could exist as separate foils similar to that of the foil of fissionable material or applied to the foil of fissionable material by electrodeposition, ion implantation, electroplating, spraying or other similar methods.

Test Results

Several metals were evaluated for recoil barriers. The requirement for these metals was mostly of a chemical nature. Because the barrier metal will bond to the uranium foil of fissionable material, it should not interfere with the dissolution and purification part of the $^{99}$Mo process.

Four metals were selected and evaluated as barrier candidates: copper, nickel, iron and zinc. The first three metals are suitable for acid dissolution process, while zinc can be utilized for a base process as well. For the current tests, copper and nickel were selected. Since the copper and nickel recoil range is approximately 7 micrometers (0.000275 inches), barriers with a predetermined thickness of approximately 10 micrometers (0.00039 inches) were evaluated.

Moreover, accepting the fact that a foil of fissionable material will bond to any material by the recoil mixing mechanism, an inner tube comprised of an inert material that may be immersed in a dissolver, allowing only the attached foil to be dissolved, is preferred. It has been found that the preferred material is a 300 type stainless steel, but other inert materials are contemplated. Specifically, types 304 and 316 stainless steel were used. Moreover, since satisfactory dismantling and foil removal are some of the key objectives of the present invention, it was determined that having an outer tube with a lower coefficient of thermal expansion than the inner tube is preferred, if not essential, as provided above. Therefore, the material for the outer tube must have a lower coefficient of thermal expansion than the stainless steel or other selected inert inner tube, preferably zirconium or nickel.

Four targets were tested. Three targets with a type 304 stainless steel inner tube and zirconium outer tube were examined: the first target had no recoil barriers and served as the control sample; the second had a 10 micrometer thick nickel barrier at the outer surface of the foil and in contact with the inner surface of the outer tube, i.e. a stainless steel-uranium-nickel-zirconium primary target; the third sample had two 10 micrometer thick copper barriers at the inner and outer surface of the foil and in contact with the inner and outer tube, i.e. a stainless steel-copper-uranium-copper-zirconium primary target. Finally, a fourth target with an aluminum inner tube and zirconium outer tube was examined that had two 10 micrometer thick nickel barriers at the inner and outer surface of the foil and in contact with the outer surface of the inner tube and the inner surface of the outer tube respectively, i.e. an aluminum-nickel-uranium-nickel-zirconium primary target.

The primary targets utilizing the recoil barriers proved to be entirely successful. The foil of the second target (stainless steel-uranium-nickel-zirconium primary target) utilizing one nickel barrier was easily extractable with no evidence of bonding at the nickel-zirconium interface, but some bonding was found at the stainless steel-uranium interface. Likewise, the foils of both the third (stainless steel-copper-uranium-copper-zirconium primary target) and fourth (aluminum-nickel-uranium-nickel-zirconium primary target) targets were easily extractable. In fact, in the third target (stainless steel-copper-uranium-copper-zirconium primary target) the foil of fissionable material easily slide off the inner tube.

While the invention has been described with reference to details of the illustrated embodiment, these details are not intended to limit the scope of the invention as defined in the appended claims.

The embodiment of the invention in which an exclusive property or privilege is claimed is defined as follows:

1. A primary target for the production of fission products comprising:

a.) an inner cylinder having an outer surface, a first end, a second end, a first raised shoulder at the first end and a second raised shoulder at the second end;

b.) a foil of fissionable material having a first surface and a second surface, whereby the foil forms a layer on the outer surface of the inner cylinder so that the foil first surface contacts the outer surface of the inner cylinder;

c.) an outer barrier having a first surface and a second surface, whereby the outer barrier forms a layer on the foil such that the outer barrier first surface contacts the foil second surface;

d.) an outer hollow cylinder selected from a material having a coefficient of thermal expansion lower than that of inner cylinder and adapted to receive the inner cylinder, having an inner surface, a first end, and a second end, so that the inner surface of the outer hollow cylinder forms a layer on the outer hollow barrier such that the outer cylinder inner surface contacts the outer barrier second surface, the outer hollow cylinder first end contacts the inner cylinder first raised shoulder and the outer hollow cylinder second end contacts the inner cylinder second raised shoulder, wherein the outer surface of the inner cylinder is tapered relative to the inner surface of the outer cylinder to ensure good physical contact between contact surfaces of the inner cylinder, the foil, the outer barrier and the outer cylinder; and e.) a means for attaching the outer cylinder first end to the inner cylinder first raised shoulder and the outer cylinder second end to the inner cylinder second raised shoulder, whereby the foil and the outer barrier are contained between the inner and outer cylinders.

2. A primary target as recited in claim 1 wherein the outer barrier is a metal selected from the group consisting of copper, nickel, iron and zinc.

3. A primary target as recited in claim 1 including an inner barrier having a first surface and a second surface, whereby the inner barrier forms a layer on the foil such that the inner barrier first surface contacts the foil first surface and the inner barrier second surface contacts the inner cylinder outer surface.

4. A primary target as recited in claim 3 wherein the inner barrier and the outer barrier are metals selected from the group consisting of copper, nickel, iron and zinc.

5. A primary target as recited in claim 4 wherein the inner barrier and the outer barrier are comprised of the same materials.

6. A primary target as recited in claim 4 wherein the inner cylinder and the outer cylinder are nonfissionable material selected from the group consisting of stainless steel, nickel, nickel alloys, zirconium, zircaloy, aluminum or zinc coated aluminum.

7. A primary target as recited as recited in claim 6 wherein the inner cylinder and outer cylinder are comprised of different materials.

8. A primary target as recited in claim 7 wherein the inner cylinder is comprised of aluminum and the outer cylinder is comprised of zirconium.

9. A primary target as recited in claim 7 wherein the inner cylinder is comprised of stainless steel and the outer cylinder is comprised of zirconium.

10. The invention as recited in claim 7 wherein the foil of fissionable material is low enriched uranium or plutonium metal.

11. A primary target as recited in claim 10 wherein the inner cylinder first and second raised shoulders are raised to the same height relative to the outer surface of the inner cylinder to accommodate a predetermined thickness of the foil.

12. A primary target as recited in claim 11 wherein the predetermined thickness of the foil is selected from a range of between approximately 0.001 inches to 0.01 inches.

13. A primary target as recited in claim 10 wherein the means for attaching is a weld.

14. A primary target as recited in claim 10 wherein the inner cylinder and the outer cylinder have a thickness selected from a range of between approximately 0.025 inches and 0.060 inches.

15. A primary target for the production of fission products comprising:

a.) an inner cylinder having an outer surface, a first end, a second end, a first raised shoulder at the first end and a second raised shoulder at the second end;

b.) an inner barrier having a first surface and a second surface, whereby the inner barrier second surface contacts the inner cylinder outer surface;

c.) a foil of fissionable material comprised of low enriched uranium or plutonium metal having a first surface and a second surface, whereby the inner barrier forms a layer on the foil first surface so that the inner barrier first surface contacts the foil first surface;

d.) an outer barrier compromised of the same material as the inner barrier having a first surface and a second surface, whereby the outer barrier forms a layer on the foil such that the outer barrier first surface contacts the foil second surface;

e.) an outer hollow cylinder selected from a material having a coefficient of thermal expansion lower than that of inner cylinder and adapted to receive the inner cylinder, having an inner surface, a first end, and a second end, so that the inner surface of the outer hollow cylinder forms a layer on the outer barrier such that the outer cylinder inner surface contacts the outer barrier second surface, the outer cylinder first end contacts the inner cylinder first raised shoulder and the outer cylinder second end contacts the inner cylinder second raised shoulder, wherein the outer surface of the inner cylinder is tapered relative to the inner surface of the outer cylinder to ensure good physical contact and thermal conductivity between contact surfaces of the inner cylinder, the inner barrier, the foil, the outer barrier and the outer cylinder; and f) a first weld attaching the outer cylinder first end to the inner surface first raised shoulder and a second weld attaching the outer cylinder second end to the inner cylinder second raised shoulder, whereby the foil and the inner and outer barriers are contained between the inner and outer cylinders.

16. A primary target as recited in claim 15 wherein the inner barrier and the outer barrier are metals selected from the group consisting of copper, nickel, iron and zinc.

17. A primary target as recited in claim 16 wherein the inner cylinder and the outer cylinder are nonfissionable material selected from the group consisting of stainless steel, nickel, nickel alloys, zirconium, zircaloy, aluminum or zinc coated aluminum.

18. A primary target as recited as recited in claim 17 wherein the inner cylinder and outer cylinder are comprised of different materials.

19. A primary target as recited in claim 18 wherein the inner cylinder first and second raised shoulders are raised to the same height relative to the outer surface of the inner cylinder to accommodate a predetermined thickness of the foil.

20. A primary target as recited in claim 19 wherein the inner cylinder and the outer cylinder have a thickness selected from a range of between approximately 0.025 inches and 0.060 inches.

* * * * *